US010893363B2

(12) United States Patent
Choisel et al.

(10) Patent No.: US 10,893,363 B2
(45) Date of Patent: Jan. 12, 2021

(54) SELF-EQUALIZING LOUDSPEAKER SYSTEM

(71) Applicant: Apple Inc., Cupertino, CA (US)

(72) Inventors: Sylvain J. Choisel, Palo Alto, CA (US); Dane R. Bush, Mountain View, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/584,065

(22) Filed: Sep. 26, 2019

(65) Prior Publication Data

US 2020/0107121 A1 Apr. 2, 2020

Related U.S. Application Data

(60) Provisional application No. 62/739,051, filed on Sep. 28, 2018.

(51) Int. Cl.

| | |
|---|---|
| ***H04R 3/04*** | (2006.01) |
| ***H04R 29/00*** | (2006.01) |
| ***H04S 7/00*** | (2006.01) |
| ***H04R 3/12*** | (2006.01) |

(52) U.S. Cl.

CPC ..... *H04R 3/04* (2013.01); *H04R 3/12* (2013.01); *H04R 29/002* (2013.01); *H04S 7/301* (2013.01); *H04S 7/307* (2013.01); *H04R 2430/01* (2013.01)

(58) Field of Classification Search

USPC ..... 381/57, 71.1, 92, 103, 107, 122, 150

See application file for complete search history.

(56) References Cited

U.S. PATENT DOCUMENTS

| | | | | |
|---|---|---|---|---|
| 7,092,537 | B1 | 8/2006 | Allred et al. | |
| 7,822,496 | B2 * | 10/2010 | Asada | H04R 3/12 381/98 |
| 8,150,047 | B2 | 4/2012 | Rabinowitz et al. | |
| 9,560,460 | B2 | 1/2017 | Chaikin et al. | |
| 10,313,808 | B1 | 6/2019 | Ramprashad et al. | |
| 10,425,733 | B1 | 9/2019 | Choisel et al. | |
| 2012/0162471 | A1 * | 6/2012 | Sekiya | G10L 21/0208 348/231.4 |
| 2017/0195790 | A1 * | 7/2017 | Choisel | H04R 3/04 |
| 2018/0352333 | A1 | 12/2018 | Kriegel et al. | |
| 2018/0352358 | A1 | 12/2018 | Choisel et al. | |

FOREIGN PATENT DOCUMENTS

WO WO2015085924 A1 6/2015

* cited by examiner

*Primary Examiner* — Yosef K Laekemariam

(74) *Attorney, Agent, or Firm* — Womble Bond Dickinson (US) LLP

(57) ABSTRACT

An impulse response is computed between i) an audio signal that is being output as sound by a loudspeaker that is integrated in a loudspeaker enclosure, and ii) a microphone signal from a microphone that is recording the output by the loudspeaker and that is also integrated in the loudspeaker enclosure. A reverberation spectrum is extracted from the impulse response. Sound power spectrum at the listening distance is computed, based on the reverberation spectrum, and an equalization filter is determined based on i) the estimated sound power spectrum and ii) a desired frequency response at the listening distance. Other aspects are also described and claimed.

20 Claims, 4 Drawing Sheets

SELF-EQUALIZING LOUDSPEAKER SYSTEM

This non-provisional patent application claims the benefit of the earlier filing date of U.S. provisional application No. 62/739,051 filed Sep. 28, 2018.

FIELD

This disclosure relates to the field of digital signal processing systems for audio signals produced by microphones in acoustic environments; and more specifically, to processing systems designed to adjust the tonal balance of a loudspeaker in a room or other acoustic space it is placed in, to improve a listeners experience. Other aspects are also described.

BACKGROUND

The sound quality of loudspeakers (as perceived by a listener) is known to be affected by the room or other acoustic space or environment (e.g., vehicle cabin) in which they are placed. A reverberant room will cause the level of a certain frequency band (depending on the acoustic characteristics of the room) to increase in such a way that timbral character is deteriorated.

SUMMARY

In accordance with various aspects of the disclosure here, digital equalization or spectral shaping is performed by an equalization filter, upon an audio signal that is driving a loudspeaker that is in a loudspeaker enclosure or cabinet. The spectral shaping may be able to compensate for deleterious effects of the acoustic environment. The effect of the acoustic environment on reverberation of the sound from the loudspeaker is measured and on that basis the equalization filter is determined. In particular, a sound measurement is made in the environment that is not at a usual listener's location in the environment. Rather, the measurement is made using one or more microphones that are integrated into the loudspeaker cabinet. In this manner, a neutral or more balanced frequency response is delivered by the loudspeaker which may be more pleasing to a listener, where this effect can adapt automatically to the ambient environment of the loudspeaker cabinet. For example, consider a smart speaker that has been placed in a reverberant bathroom. In a typical case, the smart speaker would sound louder and perhaps a little harsher than when it was in a furnished living room; the disclosed system would automatically adjust the tonal balance to make the sound less harsh and not appear unduly loud in that case. This process may be viewed as "automatic" in that no specific user intervention is required.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

In the following description, numerous details are set forth. However, it is understood that aspects of the disclosure here may be practiced without these specific details. In other instances, well-known circuits, structures and techniques have not been shown in detail in order not to obscure a rapid understanding of this description.

As used herein, the singular forms "a", "an", and "the" are intended to include the plural forms as well, unless the context indicates otherwise. It will be further understood that the terms "comprises" and "comprising" specify the presence of stated features, acts, operations, elements, or components, but do not preclude the presence or addition of one or more other features, steps, operations, elements, components, or groups thereof.

The terms "or" and "and/or" as used herein are to be interpreted as inclusive or meaning any one or any combination. Therefore, "A, B or C" or "A, B and/or C" mean any of the following: A; B; C; A and B; A and C; B and C; A, B and C." An exception to this definition will occur only when a combination of elements, functions, steps or acts are in some way inherently mutually exclusive.

Figure 1:
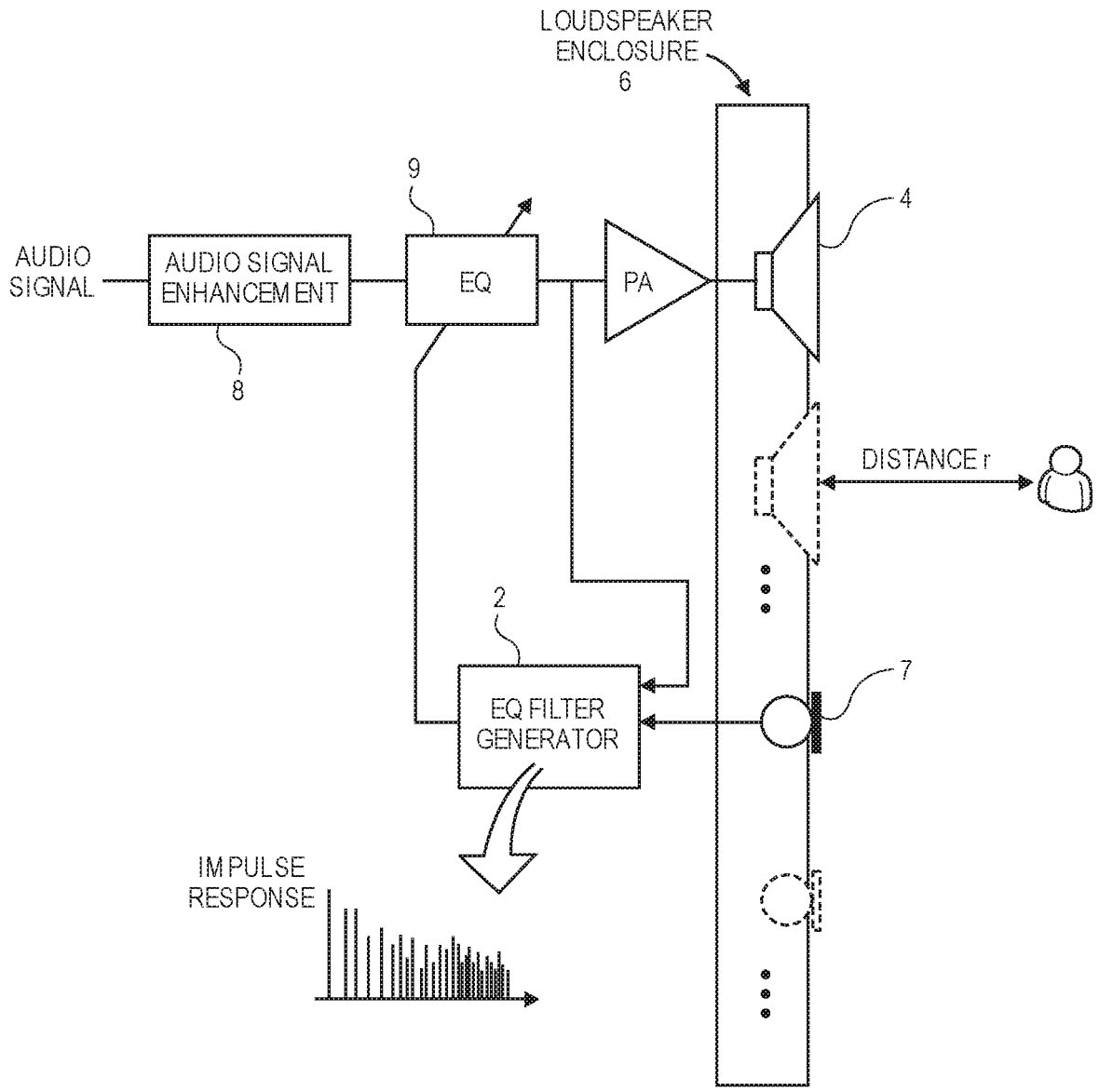
FIG. 1 is a block diagram of an audio system that generates an equalization filter for filtering an audio signal that is driving a loudspeaker.

FIG. 1 is a block diagram of one aspect of the disclosure here, as a digital audio system having a filter generator 2 and associated memory (not shown) having stored therein instructions that when executed by the processor perform the following operations that may enhance human listening experience during playback of an audio signal. Playback is through a loudspeaker 4 that is integrated in a loudspeaker enclosure 6 (cabinet), that can for example be part of a smart speaker, a laptop computer, or a tablet computer. An audio signal that may originate from a variety of different sources, e.g., a movie, music or podcast file streaming directly from a remote server or via a network appliance media player, a telephony communications downlink signal, a locally stored audio file, etc. is fed through an audio signal enhancement 8, e.g., noise reduction, dynamic range control, loudness normalization, automatic gain control, in addition to an equalization EQ filter 9, before driving the loudspeaker 4 through a power amplifier, PA. There may be multiple components in the audio signal and in that case each could be output through its respective audio signal processing and loudspeaker chain shown in the figure (in the case where there is more than one loudspeaker 4). There is also a microphone 7 integrated in the enclosure 6. The microphone 7 is arranged and designed to pick up sound in the ambient environment outside of the enclosure 6. There may be additional loudspeakers and microphones as depicted by the dotted lines, which may be used in various aspects of the equalization schemes described here.

It should be noted that depending on the particular consumer electronic product in which the aspects described here are being implemented, the digital signal processing operations described may be performed by one or more microprocessors or equivalents which are generically referred to here as "a processor", executing instructions that are stored in various types of digital storage (referred to generically here as "memory"). In fact, in one instance, the audio signal enhancement 8, the EQ filter 9 and the EQ filter generator 2 may be implemented by the processor 2 executing instructions stored in its associated memory. In other instances, certain operations may be performed by dedicated digital logic circuits, e.g. for faster response to achieve real-time adjustments in the EQ filter 9, or they may be off-loaded to a different microprocessor for example in a remote server in the case of compute-intensive signal processing tasks. Also, in one instance, all of the elements shown in FIG. 1 are implemented inside the loudspeaker enclosure 6 (e.g., as a smart speaker, a laptop computer, a smartphone, or a tablet computer), while in other instances the filter generator 2 could be implemented in a separate device such as a laptop or desktop computer and could for example send its control output signal to adjust the EQ filter 9 over a wireless communication link with a smart speaker.

The filter generator 2 computes an impulse response or equivalently a transfer function, between i) an audio signal that is being output as sound by the loudspeaker 4, and ii) a microphone signal from the microphone 7 that is recording the output by the loudspeaker 4. The stimulus audio signal may be a test tone (e.g., as part of sine sweep) or it may be user program audio signal containing for example music. The impulse response may be computed using for example an echo canceller that estimates the impulse response in real-time.

The filter generator 2 analyzes this measured impulse response to extract a reverberation level at each of a number of frequency bands of interest (e.g., frequency bins), to yield a reverberation spectrum P_rev0(f). This may be done by extrapolating the slope sound decay (decay curve) back to the beginning of the impulse response, while ignoring the direct sound and early reflections that are also present in the impulse response. The reverberation spectrum P_rev0(f) is obtained by collecting the extracted reverberation levels of the different frequency bands.

Next, a reverberation spectrum P_rev(f, r) at a listening distance r from the loudspeaker 4 is estimated, based on the reverberation spectrum P_rev0(f). This may be based on knowledge of attenuation of sound in a room, over distance. The following assumptions may be made for making this estimation. In a perfectly diffuse sound field, the reverberant sound field does not change as a function of distance in the room, and so P_rev(f,r)=P_rev0(f). Here, an empirical attenuation can be chosen that represents a central tendency of a population of typical rooms, e.g., an average. For instance, let P_rev(f,r)=P_rev0(f)/sqrt(r). Or, more generically, one can write $$P_rev(f,r)=a*P_rev0(f)/r\hat{}b \quad \text{(eq. 1)}$$

where a and b are estimated from a population of typical rooms. Note here that the parameters a and b may be further tuned based on knowledge of the room type (e.g., bathroom vs. living room vs. bed room vs. kitchen vs. garage) and/or based on distance between the loudspeaker and nearby acoustic boundaries (e.g., floor, walls, book, table top). It has been discovered that the reverberant sound field decreases more steeply as a function of distance if the loudspeaker is close to a corner of the room, whereas it does not decrease as much (as a function of distance) if the loudspeaker is in the middle of the room.

Next, the sound power spectrum at the listening distance is estimated, based on the estimated reverberation at the listening distance r. For example, the total sound power spectrum at a given distance r from the loudspeaker 4 can be estimated (reconstructed) by combining i) the direct sound (which may be based on a known on-axis response of the loudspeaker 4) and ii) the reverberant sound estimated above, using the following equation:

$$\begin{aligned} P_total(f,r) &= P_direct(f,r) + P_rev(f,r) \\ &= P_onaxis(f)/r\hat{}2 + a*P_rev(f)/r\hat{}b \end{aligned} \quad \text{(eqs. 2)}$$

And finally, the EQ filter 9 is determined (e.g., its transfer function is computed, its digital filter coefficients are computed, or a table look up is performed to select one of several previously computed digital filters) based on i) the estimated sound power spectrum and ii) a desired frequency response at the listening distance r. For instance, the transfer function H_eq(f) of the EQ filter 9 may be calculated to satisfy the following equation $$Sqrt(P_total(f))*H_eq(f)=H_target(f) \quad \text{(eq. 3)}$$

where H_target(f) is the desired frequency response at the listening distance r (e.g., listener location).

So configured, the EQ filter 9 can then filter any user audio program signal for output by the loudspeaker 4, in a way that is more acoustically pleasing for a user or listener in the present ambient environment of the enclosure 6, at least near the listening distance r from the loudspeaker 4.

Figure 2:
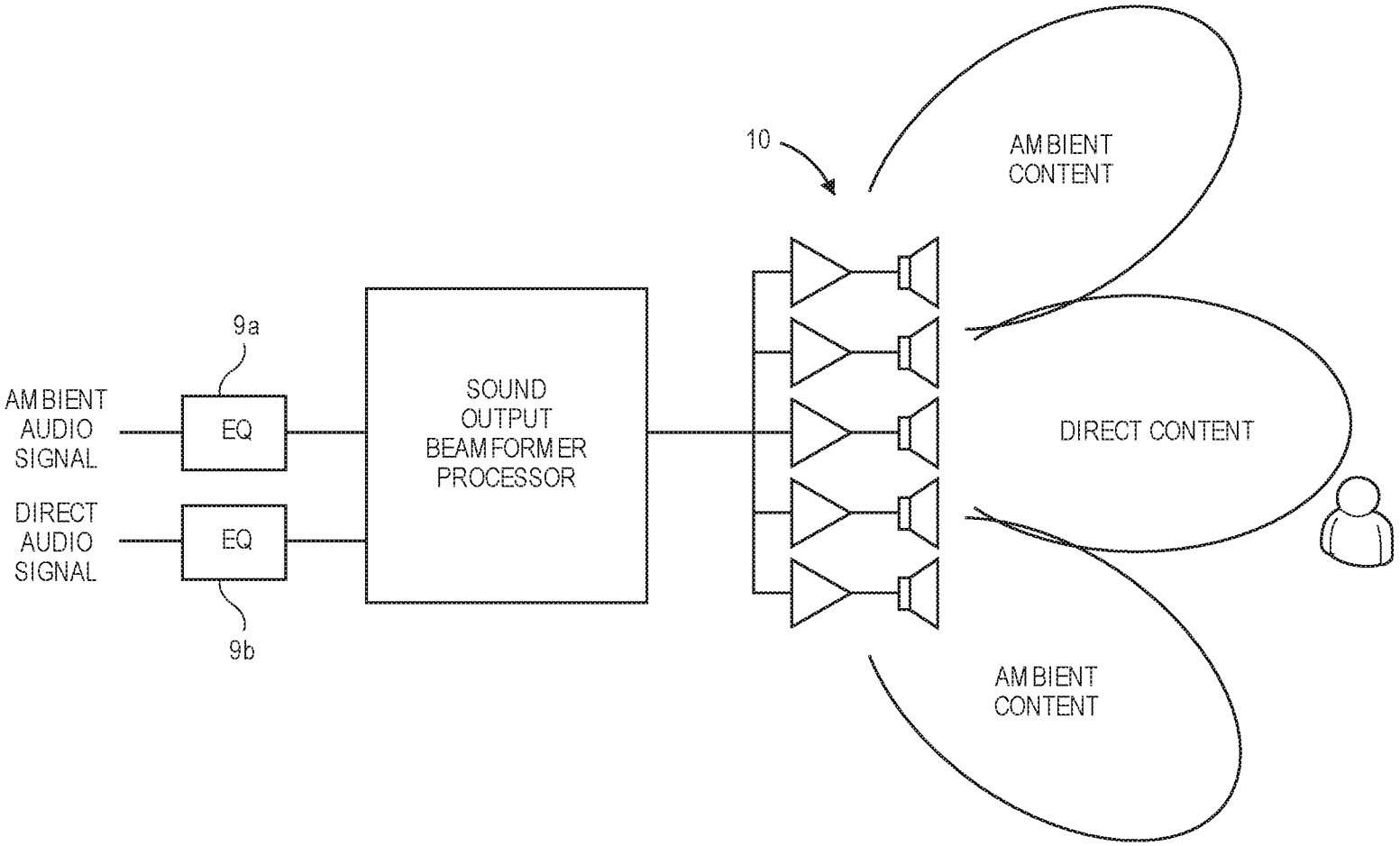
FIG. 2 is a block diagram of a beamforming audio system with equalization filters.

Referring now to FIG. 2, if the loudspeaker system is as shown there, able to produce a number of beamformer input signals (e.g., ambient audio content and direct audio content) for driving a loudspeaker array 10 to produce a number of output sound beams, respectively, with at least two different directivity indices, then each beamformer input signal may be filtered by a different instance of the EQ filter 9. In particular, for the ambient audio content that will be reproduced in the two ambient content beams shown that are directed away from the listening position (in contrast to the direct content beam which may be aimed at the listening position), the above calculations for determining its respective EQ filter **9*a* may be modified by omitting P_direct in eqs. 2 as the EQ filter 9*a*** in that instance only accounts for the diffuse sound field intended for the ambient audio signal.

While the above description refers to a microphone signal from the microphone 7 to compute P_rev, it is also possible to take multiple N>=2 microphone signals from N microphones, respectively, that are also integrated in the enclosure 6, to compute N impulse responses, respectively. In that case, N reverberation spectra would be computed, and then a single reverberation spectrum P_rev may be derived, e.g., as an average of the N spectra.

In another aspect of the disclosure, at least two sound output beams (with different directivity indices and/or in different directions, e.g. as in FIG. 2) may be used to more robustly estimate a room gain property (which is a function of frequency). This room gain property may be denoted as C(f) and is independent of the loudspeaker directivity. Since the latter is known (for the known beams that are being produced), it can be accounted for in the following relation for total sound power:

$$P_total(f,r)=P_onaxis(f)*[1/r^2+C(f,r)/D(f)]$$

where D(f) is the directivity gain of the loudspeaker beam.

In another instance, where there are several of the loudspeaker systems shown in FIG. 1 that are placed in the same room (several loudspeaker enclosures 6), where each one can compute its respective instance of the EQ filter 9, the so-called self-measurements determined by each of these systems can be shared amongst them, e.g., over wireless communication links that connect them for example as part of a computer network. This enables for example comparisons to be made to verify the likelihood that an EQ filter determination is accurate, or an average of the several self-measurements can be used to compute the individual EQ filter 9 for each system.

Figure 3:
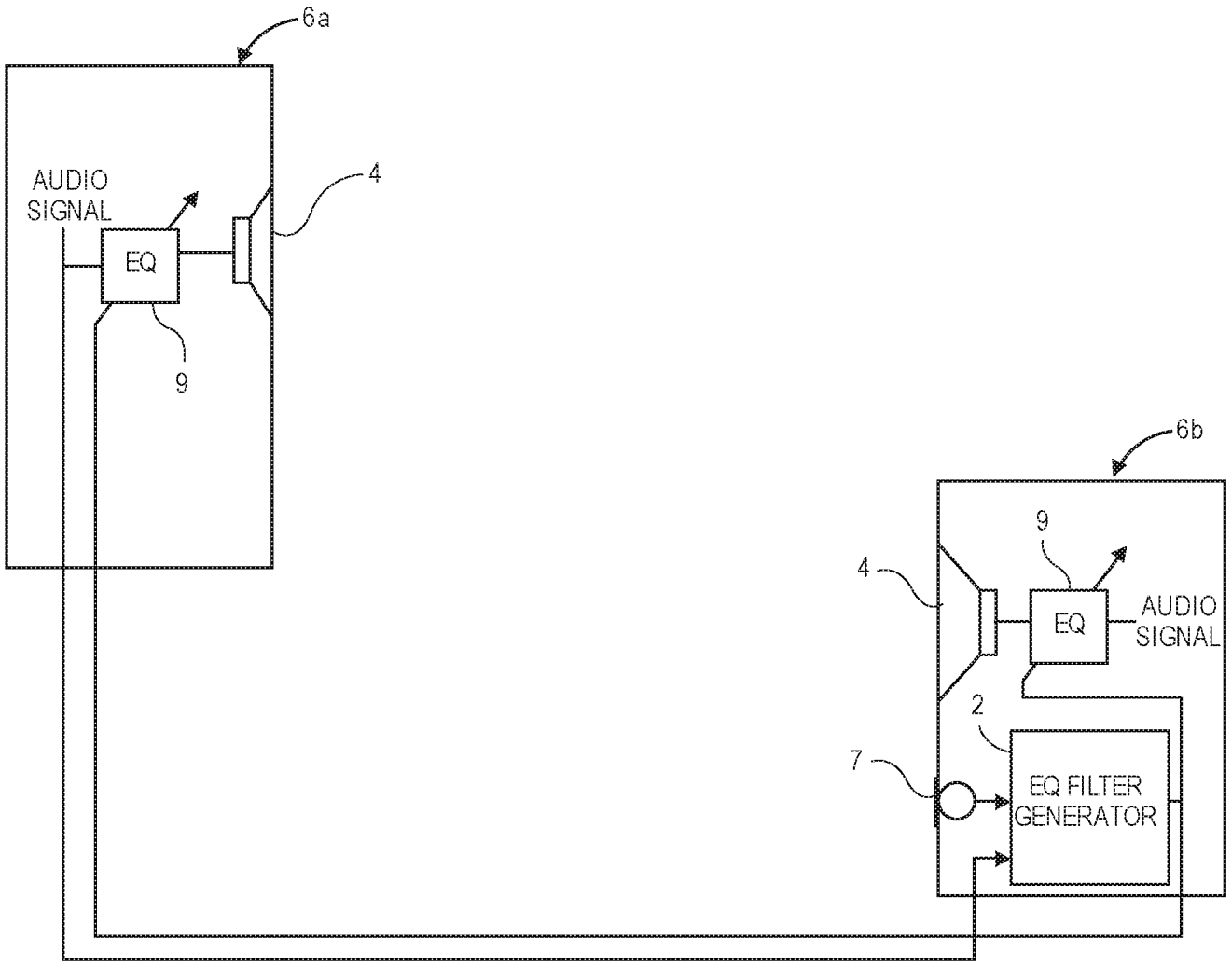
FIG. 3 shows how an EQ filter can be determined using a loudspeaker enclosure and a microphone that is outside of the loudspeaker enclosure.

In another instance, referring now to FIG. 3 where there are several of the loudspeaker systems of FIG. 1 placed in the same room, one of the loudspeaker enclosures can be used as a source (stimulus) and another can be used as a measurement device to measure the impulse response. In other words, a processor computes an impulse response between i) an audio signal that is being output as sound by a first loudspeaker that is integrated in a first loudspeaker enclosure 6*a*, and ii) a microphone signal from a microphone that is recording the output by the first loudspeaker, wherein the microphone is separate from the first loudspeaker enclosure, e.g., it is integrated in another loudspeaker enclosure 6*b* in the room or is otherwise located outside of the loudspeaker enclosure 6*b*. In this way, the extrapolation operation described above that is part of analyzing the impulse response to extract therefrom the reverberation spectrum, is made easier since the direct sound from one loudspeaker enclosure that is arriving at the microphone which is now in another enclosure is not as dominant as in the single loudspeaker enclosure case illustrated in FIG. 1 where the microphone 7 is close to the loudspeaker.

It should also be noted that the EQ filter 9 as described above may be restricted to operate in a certain frequency range, e.g., affecting its input audio signal only at 1 kHz and above. It may also be combined with another spectral shaping (equalization) filter that operates at lower frequencies, e.g., below 1 kHz. Also, the processors determination of the EQ filter 9 may be updated or repeated, whenever the computed impulse response changes more than a threshold amount, and/or it may be computed during a setup phase, e.g., upon each power up event, or waking from a sleep state.

In yet another instance, the processor could apply the EQ filter 9, to filter the user audio program signal being output by the loudspeaker 4, in response to a user volume setting of the loudspeaker system being changed.

In still another instance, a broad-band room gain property (e.g. covering the entire range between 1 and 8 kHz) is computed and is then used to either 1) change the sound output gain (that is applied to the audio signal during playback), in such a way that the loudspeaker 4 outputs sound at the same level in different rooms, or 2) perform a more informed loudness compensation (e.g., using a Fletcher-Munson curve), by taking into account a corrected loudspeaker sensitivity (that includes the room gain). Although the broad-band room gain property ("room gain") is estimated at higher frequencies (e.g. it is undefined below 1 kHz, and defined between 1 kHz to 8 kHz or perhaps even higher), it has been determined that in most rooms the frequency-dependency of the room gain is not strong. This suggests that the broad-band room gain would also be valid when applied to the lower frequency range of the audio signal that is driving the loudspeaker, e.g., lower than 1 kHz.

Note that one reason why the measurement of the broad band room gain may have a high pass characteristic is that it is easier to remove the near-field effects of reflections at high frequencies. Near-field low-frequency measurements do not translate well to the estimation of the far-field room-gain.

Applying such loudness compensation (using the computed broad band room gain) results in a more appropriate spectral balance. For instance, in a bathroom the room gain could be around 10 dB; the loudness compensation will in that case result in a bass cut of around 4 dB. These numbers of course are just one example of the loudness compensation described here.

Figure 4:
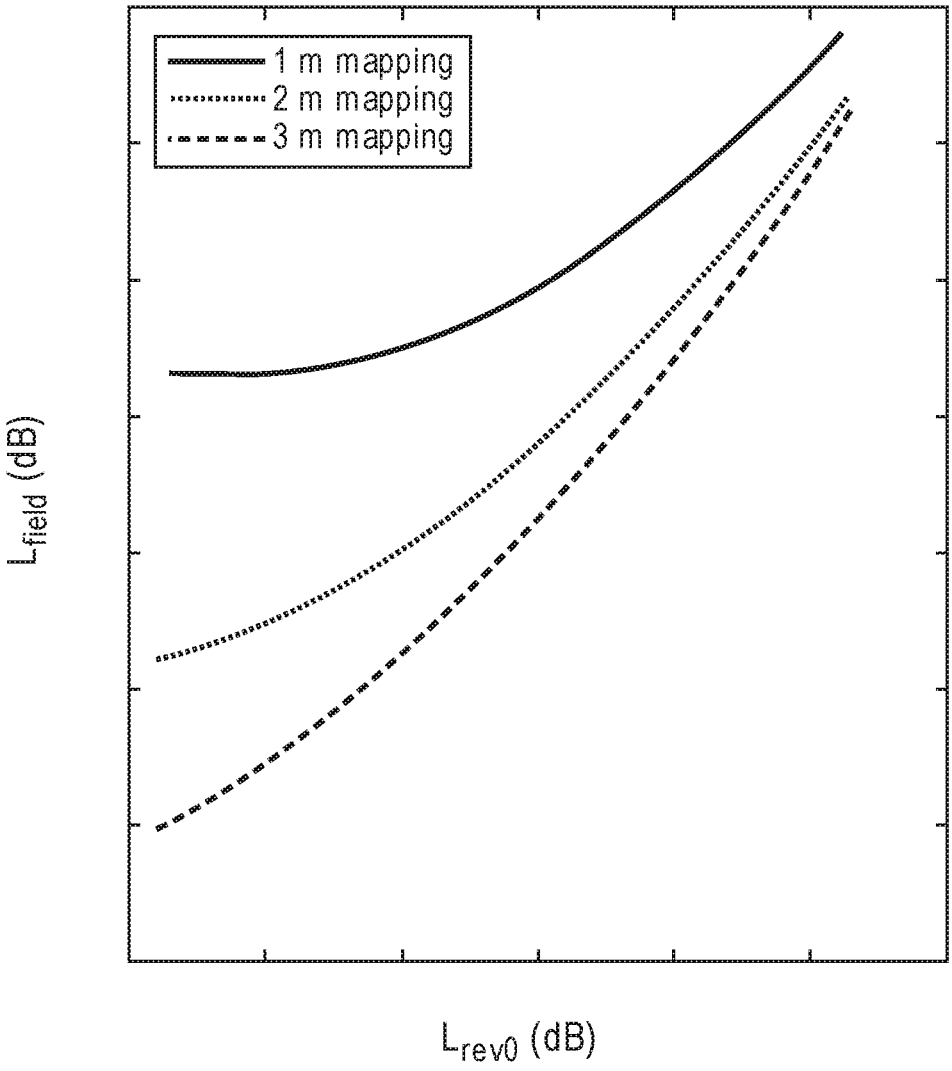
FIG. 4 illustrates a plot of reverberant sound field measurement versus a parameter that indicates the room gain, at three different distances from the loudspeaker enclosure.

The room gain may be computed as follows. Note that this process which also estimates a reverberation level is less complex than the one mentioned above (the decay curve analysis.) In such a process, the direct sound and early reflections in the impulse response are windowed out (e.g., the first ten milliseconds are cut out.) This is then band-pass or high pass filtered, e.g., as a second order Butterworth-type high pass filter having a cutoff at 400 Hz, and then the RMS level of the filtered signal is calculated. That RMS level represents the measured or estimated level of the reverberant sound field observed by the device, also referred to here as Lrev0. A mapping is then performed using a predetermined relationship that relates reverberant sound field levels to predicted room gains (spectra), at a given distance in the room from the loudspeaker 4. One solution is to use equations 1 and 2, where Prev0 is equivalent to 10^(Lrev0/10). Another solution is to use a pre-calculated mapping curve. For example, FIG. 4 illustrates a mapping of reverberant sound field measurements Lrev0 to the estimated far-field level Lfield, at three different distances from the loudspeaker enclosure (in this example, 1 meter, 2 meters and 3 meters.) If the actual listening distance is not known or cannot be estimated reliably, then a default distance may be selected, e.g., 2 meters, and its associated mapping curve is selected. Room gain is then calculated as the difference (in dB) between Lfield and a reference level (which could come from a measurement for a specific loudspeaker system at an ideal listening distance in a reference room.)

While certain exemplary instances have been described and shown in the accompanying drawings, it is to be understood that these are merely illustrative of and not restrictive on the broad invention, and that this invention is not limited to the specific constructions and arrangements shown and described, since various other modifications may occur to those of ordinary skill in the art. For example, the listening distance r may be entered manually by a user, or it may be estimated by the processor using proximity sensing, voice analysis, or camera image analysis, or it may be set to a default fixed value, e.g., three meters. The description is thus to be regarded as illustrative instead of limiting.

What is claimed is:

1. A digital audio equalization system comprising:

a processor and non-transitory memory having stored therein instructions that when executed by the processor compute an impulse response between i) an audio signal that is being output as sound by a loudspeaker that is integrated in a loudspeaker enclosure, and ii) a microphone signal from a microphone that is recording the output by the loudspeaker and that is also integrated in the loudspeaker enclosure, analyze the impulse response to extract a reverberation level at each of a plurality of frequency bands, to yield a reverberation spectrum, estimate sound power spectrum at a listening distance from the loudspeaker, based on the reverberation spectrum, and determine an equalization filter based on i) the estimated sound power spectrum and ii) a desired frequency response at the listening distance, wherein the equalization filter is to filter a user audio program signal for output by the loudspeaker.

2. The system of claim 1 wherein the audio signal is a user audio program signal.

3. The system of claim 1 wherein the audio signal is a test tone signal.

4. The system of claim 1 wherein the memory has stored therein instructions that when executed by the processor implement an echo canceller to compute the impulse response.

5. The system of claim 1 wherein the memory has stored therein further instructions that when executed the processor produce a plurality of beamformer input signals for driving a loudspeaker array to produce a plurality of output sound beams, respectively, with different directivity indices, and wherein each beamformer input signal is filtered by a different instance of the equalization filter.

6. The system of claim 1 wherein the impulse response is computed by combining a plurality of individual impulse responses that have been computed for a plurality of microphones, respectively, that are integrated in the loudspeaker enclosure.

7. The system of claim 1 wherein the listening distance is entered manually by a user, estimated using proximity sensing, voice analysis, or camera image analysis, or set to a default fixed value.

8. The system of claim 1 wherein the processor applies the equalization filter, to filter the user audio program signal for output by the loudspeaker, in response to a user volume setting changing.

9. The system of claim 1 wherein the processor updates the determination of the equalization filter whenever the computed impulse response changes more than a threshold amount.

10. A digital audio equalization system comprising:

a processor and non-transitory memory having stored therein instructions that when executed by the processor compute an impulse response between i) an audio signal that is being output as sound by a first loudspeaker that is integrated in a first loudspeaker enclosure, and ii) a microphone signal from a microphone that is recording the output by the loudspeaker, wherein the microphone is separate from the first loudspeaker enclosure, analyze the impulse response to extract a reverberation level at each of a plurality of frequency bands, to yield a reverberation spectrum, estimate sound power spectrum at a listening distance, based on the reverberation spectrum, and determine an equalization filter based on i) the estimated sound power spectrum and ii) a desired frequency response at the listening distance, wherein the equalization filter is to filter a user audio program signal for output by the first loudspeaker.

11. The system of claim 10 wherein the audio signal is a user audio program signal.

12. The system of claim 10 wherein the audio signal is a test tone signal.

13. The system of claim 10 wherein the listening distance is entered manually by a user, estimated using proximity sensing, voice analysis, or camera image analysis, or set to a default fixed value.

14. The system of claim 10 wherein the processor applies the equalization filter, to filter the user audio program signal for output by the loudspeaker, in response to a user volume setting changing.

15. The system of claim 10 wherein the processor updates the determination of the equalization filter, whenever the computed impulse response changes more than a threshold amount.

16. The system of claim 10 wherein the microphone is integrated in a second loudspeaker enclosure along with a second loudspeaker.

17. A method for loudness compensation of a program audio signal that is being output as sound by a loudspeaker, the method comprising:

determining an impulse response between i) an audio signal that is being output as sound by a loudspeaker that is integrated in a loudspeaker enclosure, and ii) a microphone signal from a microphone that is recording the output by the loudspeaker;

windowing out direct sound and early reflections from the impulse response and then band-pass or high pass filtering the impulse response to produce a filtered response, and computing a level of the filtered response;

selecting a room gain property based on the computed level; and changing a gain that is applied to a program audio signal that is being output as sound by the loudspeaker, based on the selected room gain property.

18. The method of claim 17 wherein the high pass filtering has a cut off frequency that is between 300 Hz-1 kHz.

19. The method of claim 17 wherein changing the gain that is applied to the program audio signal comprises changing a scalar or broad band gain that is applied to the program audio signal, based on the selected room gain property, to cause the loudspeaker to output sound that is perceived to be at the same level in different rooms.

20. The method of claim 17 wherein changing the gain that is applied to the program audio signal comprises modifying a spectral shaping filter that is applied to the program audio signal to compensate for perceived timbral differences resulting from loudness differences in different rooms.

* * * * *